US007296385B2

(12) United States Patent
Andra et al.

(10) Patent No.: US 7,296,385 B2
(45) Date of Patent: Nov. 20, 2007

(54) METHOD OF INSTALLING TENSION MEMBERS ON SUPPORTING STRUCTURES, AND APPARATUS FOR PERFORMING THE METHOD

(75) Inventors: Hans-Peter Andra, Stuttgart (DE); Markus Maier, Stuttgart (DE)

(73) Assignee: Leonhardt, Andra und Partner Beratende Ingenieure VBI GmbH, Stuttgart (DE)

( * ) Notice: Subject to any disclaimer, the term of this patent is extended or adjusted under 35 U.S.C. 154(b) by 138 days.

(21) Appl. No.: 10/906,313

(22) Filed: Feb. 14, 2005

(65) Prior Publication Data

US 2005/0247016 A1 Nov. 10, 2005

Related U.S. Application Data

(63) Continuation of application No. PCT/EP03/09091, filed on Aug. 16, 2003.

(51) Int. Cl.
*E04C 5/08* (2006.01)

(52) U.S. Cl. ..... 52/223.14; 52/223.8; 52/223.13; 52/745.21

(58) Field of Classification Search ..... 52/223.8, 52/223.9, 730.2, 724.2, 724.5, 745.21, 707, 52/713, 223.14, 223.11, 223.13, 698
See application file for complete search history.

(56) References Cited

U.S. PATENT DOCUMENTS 5,479,748 A * 1/1996 Siller ..... 52/231
5,617,685 A 4/1997 Meier
6,389,775 B1 5/2002 Steiner
6,464,811 B1 10/2002 Meier
6,584,738 B1 7/2003 Andra
7,047,704 B1 * 5/2006 Han ..... 52/745.19

FOREIGN PATENT DOCUMENTS

| | | |
|---|---|---|
| BE | 1013910 | 12/2002 |
| EP | 1033455 | 9/2000 |
| JP | 11182061 | 7/1999 |

OTHER PUBLICATIONS

International Search Report from corresponding PCT/EP03/09091 in which references cited on preceding page are cited.

* cited by examiner

*Primary Examiner*—Richard E. Chilcot, Jr.
*Assistant Examiner*—Jessica Laux
(74) *Attorney, Agent, or Firm*—WRB-IP LLP

(57) ABSTRACT

Pre-stressed, strip-type tension members are applied to supporting structures, especially concrete supporting structures. To this end, a clamping device is used to pre-stress the tension member at least at one end, at a distance from the surface of the supporting structure, by a temporary clamping element which is fixed to the tension member, and the tension member is then pressed onto the surface by at least one permanent brace. The two temporary clamping elements are removed from the surface once the tension member has been pressed onto the surface.

13 Claims, 5 Drawing Sheets

METHOD OF INSTALLING TENSION MEMBERS ON SUPPORTING STRUCTURES, AND APPARATUS FOR PERFORMING THE METHOD

The present application is a continuation of International Application No. PCT/EP2003/009091, filed Aug. 16, 2003, and claims priority to German Application No. 102 37 968.8, filed Aug. 20, 2002, both of which applications are hereby incorporated by reference.

BACKGROUND

The invention relates to a method for installing tensioned strip-shaped tension members on supporting structures, particularly concrete supporting structures, wherein the tension member is tensioned at least at one end by means of a tensioning device clamped via a temporary clamping anchor fastened to the tension member, and is then anchored to the supporting structure by means of a permanent anchoring device.

To increase the load-carrying capacity (strengthening) or for recovery of the original load-bearing capacity (rehabilitation) of supporting structures, particularly supporting structures of steel and reinforced concrete, it is known to subsequently install strip-shaped tension members on the surface of the supporting structure, preferably plate-like tension members of plastic with fibers, particularly carbon fibers, embedded for reinforcing. If these tension members are anchored in the pre-stressed state, the load-bearing capacity and the use capability are additionally considerably improved. It is known (DE 198 49 605 A1) to anchor for this purpose the strip-shaped tension members arranged flush with the surface on steel baseplates which are let into the concrete surface.

Supporting structures of steel or wooden components can be rehabilitated or strengthened in a corresponding manner.

The production of the recess, necessary for this purpose, in the concrete surface in the region of the anchoring devices is expensive and can lead to damage to the reinforcement embedded in the concrete. What makes matters worse is that this necessary recess at the clamping end of the tension member depends not only on the size of the baseplate provided for permanent anchoring, but also on the clamping path of the clamping device arranged there. These recesses are therefore of considerable size in the case of long tension members which require a large clamping path. The baseplate remaining in the concrete supporting structure also increases the costs of anchoring the tension member.

The invention therefore has as its object to provide a method, of the category named at the beginning, such that the anchoring of tension members flush with the surface is substantially simplified.

This object is attained according to the invention in that the tension member is tensioned by means of the temporary clamping anchor at a distance from the surface of the supporting structure, and that the tension member is then pressed onto the surface by means of at least one permanent anchoring clamp.

Since the tension member is located during the tensioning process at a distance from the surface of the supporting structure, the ends of the tension member can be fastened by clamping to temporary clamping anchors on a clamping plate of the temporary clamping anchor, located under the tension member, without a recess having to be produced for this clamping plate in the surface of the supporting structure.

By means of the subsequent pressing of the tension member onto the surface by means of a permanent anchoring clamp, the frictional connection is produced between the tension member and the supporting structure, the strip-shaped tension member now being arranged flush to the surface. The introduction of the tensioning force takes place using the pressing force of the anchoring clamp, so that the temporary clamping anchor arranged between the anchoring clamp and the end of the tension member can be removed.

It is thus no longer necessary to provide a baseplate remaining on the supporting structure and to produce a recess for sinking this baseplate. New fields of application in which recesses for the baseplate and the clamping path are not actually possible are thus opened up for the method, so that even carrying the method over to steel supporting structures or wooden supporting structures is made possible.

A further particular advantage of the method according to the invention consists in that it can also be used with arched supporting structures, particularly concrete supporting structures, for example floor slabs in bridge building, wherein the tensioning force of the tension elements can be introduced directly at the edge of the arch. This is not possible with the conventional way of installing clamped strip-shaped tension members on concrete supporting structures. The tensioning force cannot be directly introduced to the arch, at least on the clamping anchor side, since the recess required for the clamping device would penetrate too far into the arch region and possibly the arch reinforcement would be penetrated.

As a development of the invention, it is provided that the tension member is clamped between two temporary clamping anchors fastened at the two ends of the tension member, at a distance from the surface of the supporting structure, and that the tension member is subsequently pressed onto the surface near its two ends, each by means of a respective permanent anchor clamp.

The invention also relates to an apparatus for carrying out the method. Starting from a known apparatus (DE 198 49 605 A1) with a strip-shaped tension member, which is connected at least at one end to a temporary clamping anchor, with a tensioning device engaging on the temporary clamping anchor during the tensioning process, and with a permanent anchoring device, the apparatus according to the invention is characterized in that a baseplate of the temporary clamping anchor is arranged between the tension member and the surface of the supporting structure, and in that at least one permanent anchoring clamp engages over the tension member near the temporary clamping anchor and can be pressed against the surface.

In comparison with the known apparatus, the apparatus according to the invention is substantially more cost-effective, since no permanent clamping plates remain on the supporting structure, and since no recesses have to be provided for these in the surface.

The strip-shaped tension member can be pressed directly onto the surface. In embodying the concept of the invention, it is also possible to arrange between the tension member and the surface of the supporting structure and/or the anchoring clamp, an adhesive layer which hardens after the tension member has been pressed onto the surface.

The adhesive layer enhances or takes over the force-transmitting connection between the tension member and the surface or the anchor clamp respectively.

It is also possible to adhere an intermediate layer which increases friction and/or distributes load in the region of the anchoring clamp.

BRIEF DESCRIPTION OF THE DRAWINGS

The invention is explained in detail hereinafter in embodiment examples which are shown in the accompanying drawings.

DETAILED DESCRIPTION

Figure 1:
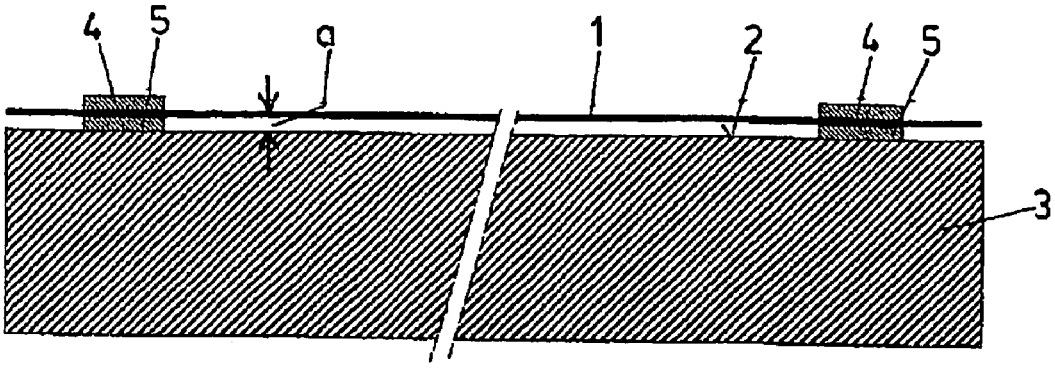
FIG. 1 shows, in a simplified illustration, a concrete supporting structure with a pre-stressed tension member arranged at a spacing from the concrete surface.

A strip-shaped suspension member 1 (FIG. 1) is provided for installation on a concrete surface 2 of a concrete supporting structure 3 for increasing the present load-bearing capacity. For this purpose, the tension member 1, first arranged at a distance a from the concrete surface 2 of the concrete supporting structure 3, is fastened at each end to a respective temporary clamping anchor 4, a lower clamping plate 5 of the temporary clamping anchor, whose thickness equals the distance a, coming to lie between the underside of the tension member 1 and the concrete surface 2.

The required pre-stressing force is then applied to the tension member 1 by opposed tensioning of the temporary clamping anchors 4. Preferably here one of the two temporary clamping anchors 4 is fixed to the concrete supporting structure 3, while the other temporary clamping anchor 4 is pre-stressed in the required amount by means of a tensioning device (not shown), as is known, for example, from DE 198 49 605 A1.

Figure 7:
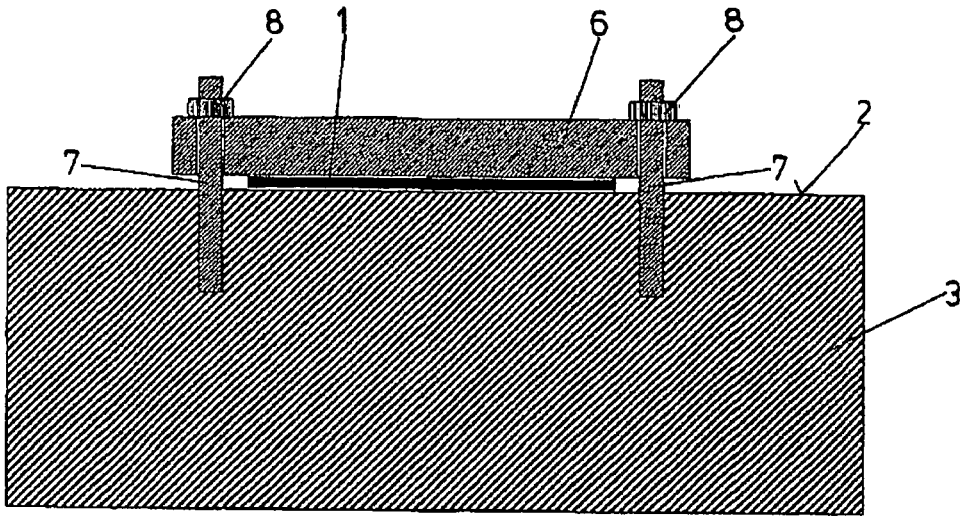
FIG. 7 shows an enlarged section along the line VII-VII of FIG. 2.

A respective anchoring clamp 6 is then installed at a small distance in front of each of the two temporary clamping anchors 4 and—since it later remains on the concrete supporting structure 3—is denoted in this connection as a permanent anchor clamp 6. The permanent anchor clamp 6 (FIG. 7) is pressed onto the tension member 1 by means of screw bolts 7 and clamping nuts 8 let into the concrete supporting structure 3 on both sides of the tension member 1, so that this tension member 1 is pressed against the concrete surface 2. The pressing force thus exerted effects a frictional connection between the pre-stressed tension member 1 arranged flush with the surface and the concrete surface 2.

Figure 3:
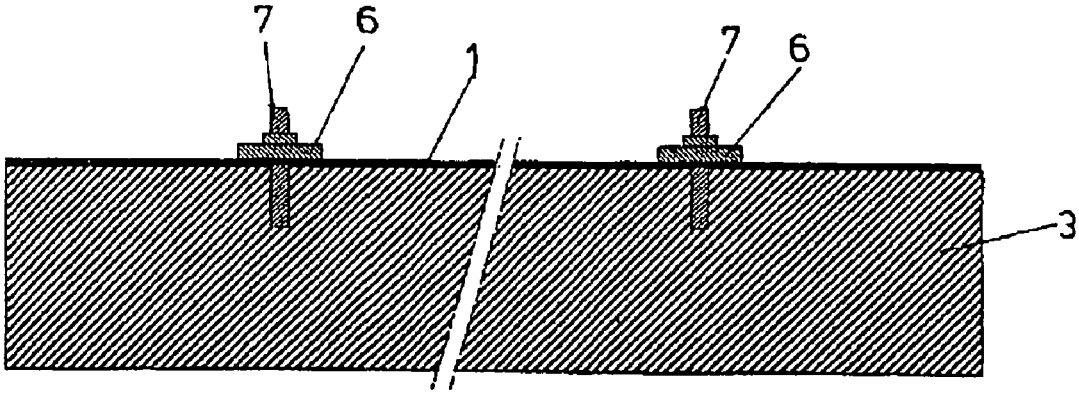
FIG. 3 shows, in a cross section corresponding to FIGS. 1 and 2, the arrangement of the strip-shaped tension member on the concrete surface after removal of the temporary clamping anchor.

The two temporary clamping anchors are then removed after pressing the tension member 1 onto the concrete surface 2 (FIG. 3).

Figure 2:
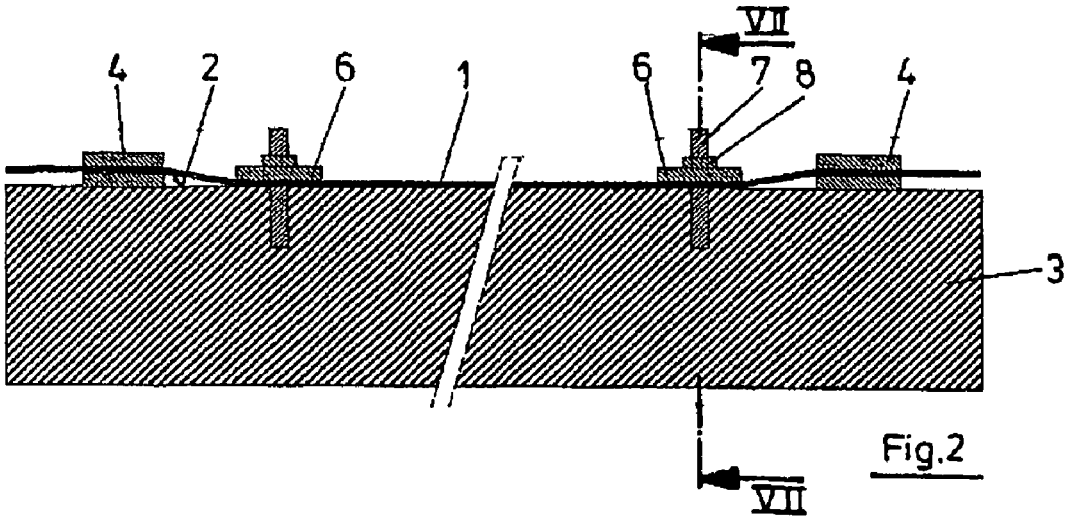
FIG. 2 shows a cross section corresponding to FIG. 1, after the tension member has been pressed against the concrete surface by means of anchoring clamps.
Figure 4:
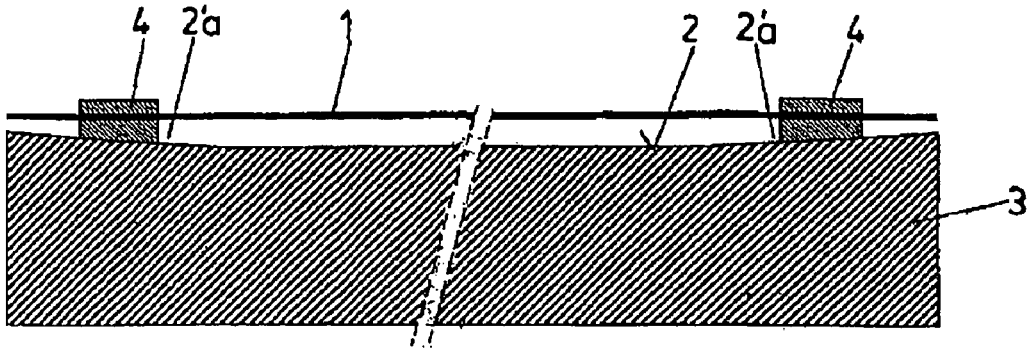
FIGS. 4-6 show, in diagrams corresponding to FIGS. 1-3, the process steps for application to an arched concrete supporting structure.
Figure 5:
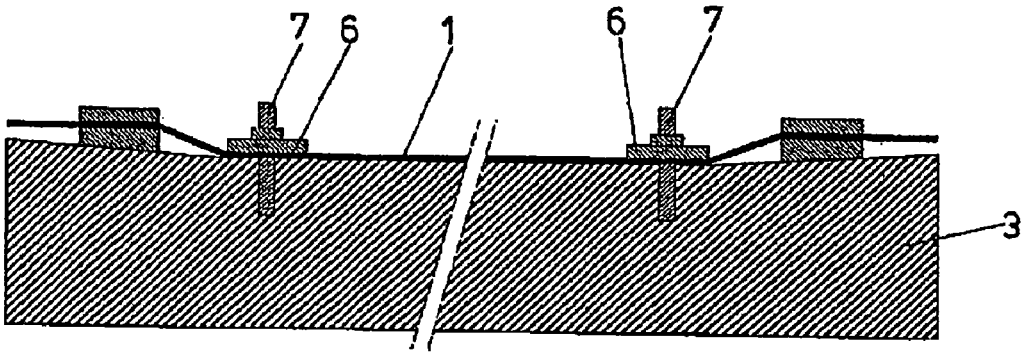
Figure 6:
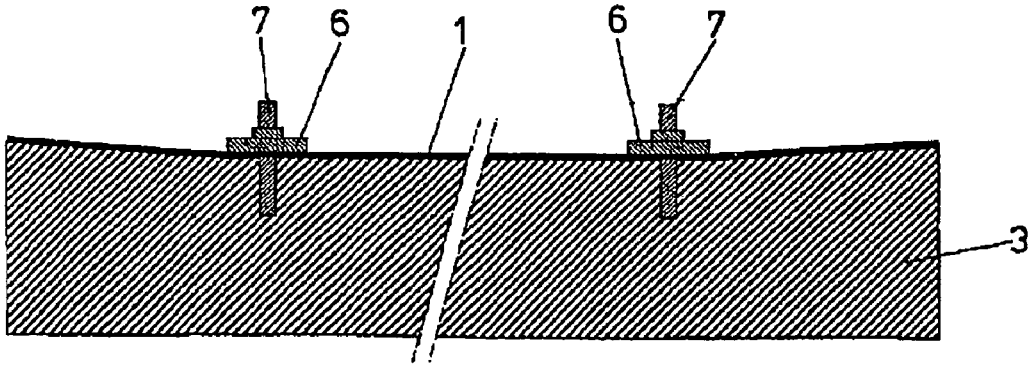

It is shown in FIGS. 4-6, which correspond to FIGS. 1-3, that the described method steps for installing the tension member 1 on a concrete supporting structure 3 can also be performed when the concrete surface 2' has a respective arch 2'*a* at the two ends of the concrete supporting structure 3, i.e., a region which rises relative to the middle region of the concrete surface 2'. The two temporary clamping anchors 4 are here located in the region of the arch 2'*a*, also without a recess being required here in the surface region of the concrete supporting structure 3.

In the manner already described, the tension member 1 is pressed by the permanent anchor clamps 6 onto the concrete surface 2' (FIG. 5). The temporary clamping anchors 4 are thereafter removed (FIG. 6).

In the two described embodiments, on removing the temporary clamping anchors 4, the deflecting force which arises on pressing the anchoring clamps 6, on the one hand onto the anchoring of the anchoring clamp 6, and on the other hand onto the clamping plate 5 of the temporary clamping anchor 4, is redistributed into a pressing force between the anchoring clamp 6 and the concrete supporting structure 3. The tension member 1 is thereby clamped between the concrete surface 2 or 2' and the anchoring clamp 6.

Figure 8:
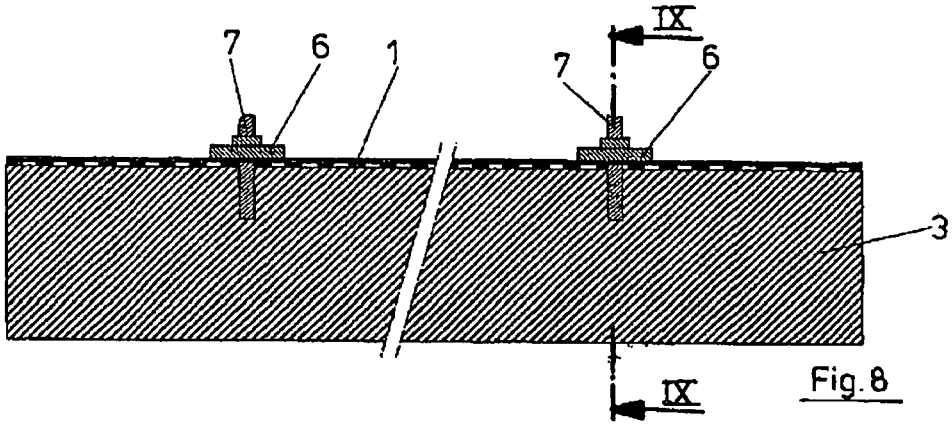
FIG. 8 shows, in a section corresponding to FIG. 3, an embodiment with an adhesive layer arranged between the tension member and the concrete surface.
Figure 9:
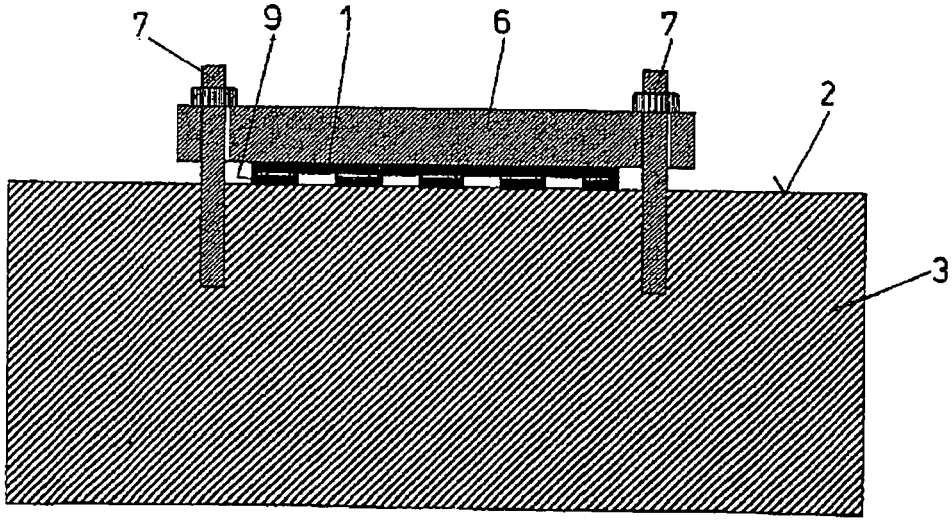
FIG. 9 shows an enlarged section along the line IX-IX in FIG. 8.

As shown in FIGS. 8 and 9, an adhesive layer 9 can be arranged between the tension member 1 and the concrete surface 2, and hardens after the tension member 1 has been pressed onto the concrete surface 2.

Figure 10:
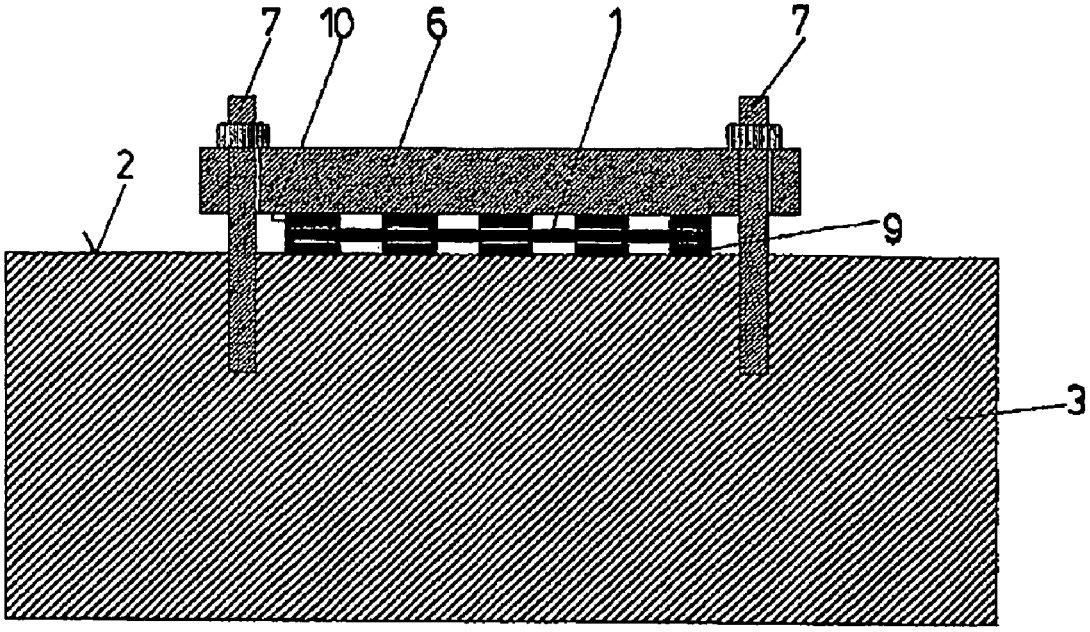
FIGS. 10-12 show modified embodiments in sections corresponding to FIG. 9.

It is shown in FIG. 10 that an adhesive layer 10 can also be arranged between the tension member 1 and the anchoring clamp 6, and hardens after pressing the tension member 1 onto the concrete surface 2.

Figure 11:
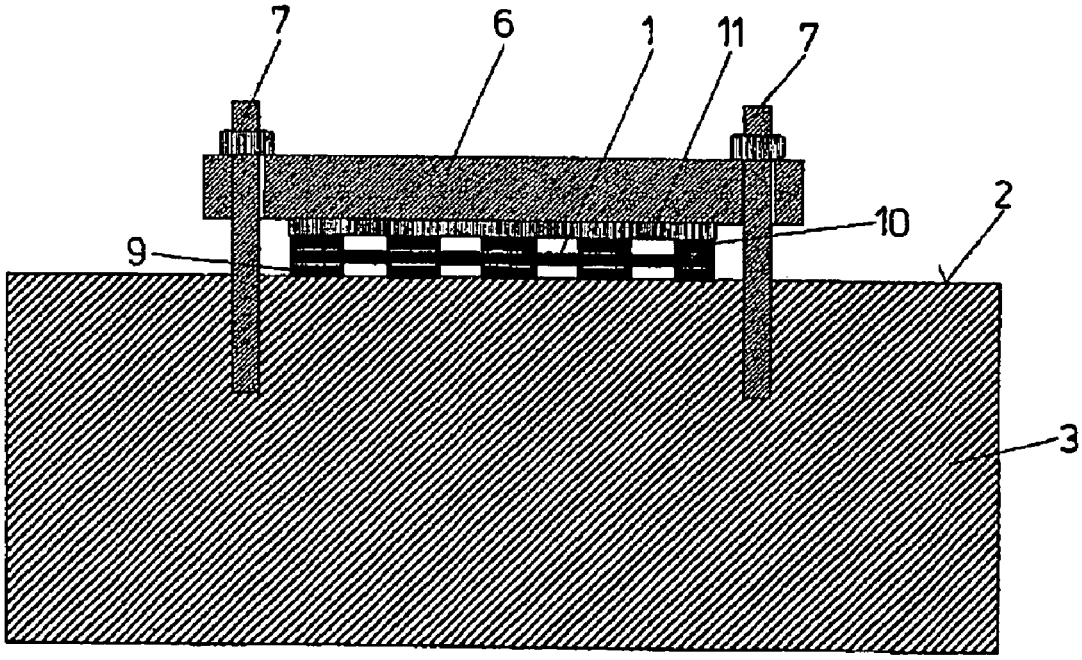

In the embodiment example according to FIG. 11, an intermediate layer 11 which increases friction and/or distributes load, for example of steel, is adhered to the tension member 1 by means of the adhesive layer 10 in the region of the anchoring clamp 7.

Figure 12:
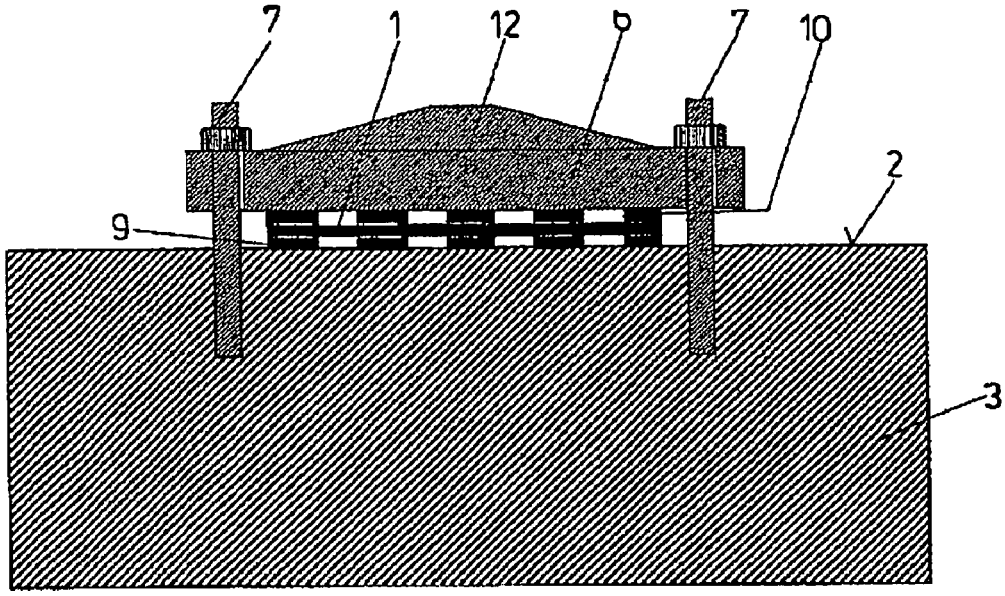

FIG. 12 shows a further embodiment, in which the anchoring clamp 6 has on its upper side a stiffening rib 12, which acts to produce a uniform clamping pressure. Instead of this, or additionally, a spring-like load distributing plate can also be arranged on the anchoring clamp 6.

What is claimed is:

1. Method of installing tensioned strip-shaped tension members on supporting structures, comprising:

clamping the tension member, with a temporary clamping anchor, at a non-zero distance from a generally planar portion of a surface of the supporting structure tensioning the tension member via the temporary clamping anchor fastened to the tension member;

pressing the tension member below the non-zero distance at which the tension member is clamped by the temporary clamping anchor and onto the surface by a permanent anchoring clamp; and anchoring the tension member to the supporting structure using the permanent anchoring device.

2. Method according to claim 1, comprising clamping the tension member at a distance from the surface between two temporary clamping anchors fastened to ends of the tension member, and pressing the tension member near its two ends by respective permanent anchoring clamps onto the surface.

3. Method according to claim 2, wherein the two temporary clamping anchors are removed after pressing the tension member onto the surface.

4. Method according to claim 1, wherein the temporary clamping anchor is removed after pressing the tension member onto the surface.

5. Apparatus for tensioning strip-shaped tension members on a supporting structure, comprising:

a strip-shaped tension member;

a temporary clamping anchor connected to the tension member, the temporary clamping anchor having a clamping plate arranged below the tension member to clamp the tension member at a non-zero distance from a generally planar portion of a surface of the supporting structure; and at least one permanent anchoring clamp engaged over the tension member proximate the temporary clamping anchor so as to press the tension member below the non-zero distance at which the tension member is clamped by the temporary clamping anchor and onto the surface.

6. Apparatus according to claim 5, comprising an adhesive layer adapted to be arranged between the tension member and the surface and to harden after the tension member is pressed onto the surface.

7. Apparatus according to claim 6, comprising an adhesive layer adapted to be arranged between the tension member and the anchoring clamp and to harden after the tension member is pressed onto the surface.

8. Apparatus according to claim 5, comprising an adhesive layer adapted to be arranged between the tension member and the anchoring clamp and to harden after the tension member is pressed onto the surface.

9. Apparatus according to claim 5, comprising a friction-increasing intermediate layer adhered on the tension member proximate the anchoring clamp.

10. Apparatus according to claim 5, comprising an intermediate layer adhered on the tension member proximate the anchoring clamp.

11. Apparatus according to claim 10, wherein the intermediate layer is a load-distributing layer.

12. Apparatus according to claim 5, wherein the anchoring clamp has at least one stiffening rib on an upper side thereof.

13. Apparatus according to claim 5, wherein spring-like load distributing plates are arranged on the anchoring clamp.

* * * * *